US009402419B2

(12) United States Patent
Roila et al.

(10) Patent No.: US 9,402,419 B2
(45) Date of Patent: Aug. 2, 2016

(54) PACKET FOR TOBACCO PRODUCTS

(71) Applicant: G.D S.p.A., Bologna (IT)

(72) Inventors: Patrizio Roila, Perugia (IT); Roberto Polloni, Forlí-Cesena (IT); Marco Ghini, Bologna (IT); Stefano Negrini, Bologna (IT)

(73) Assignee: G.D S.p.A. (IT)

( * ) Notice: Subject to any disclaimer, the term of this patent is extended or adjusted under 35 U.S.C. 154(b) by 7 days.

(21) Appl. No.: 14/377,709

(22) PCT Filed: Mar. 4, 2013

(86) PCT No.: PCT/IB2013/051708

§ 371 (c)(1),
(2) Date: Aug. 8, 2014

(87) PCT Pub. No.: WO2013/132413

PCT Pub. Date: Sep. 12, 2013

(65) Prior Publication Data

US 2015/0264977 A1 Sep. 24, 2015

(30) Foreign Application Priority Data

Mar. 7, 2012 (IT) ..... BO2012A0112

(51) Int. Cl.
*A24F 15/12* (2006.01)
*B65D 85/10* (2006.01)
*B65D 5/38* (2006.01)

(52) U.S. Cl.
CPC . *A24F 15/12* (2013.01); *B65D 5/38* (2013.01); *B65D 85/1009* (2013.01); *B65D 85/1036* (2013.01)

(58) Field of Classification Search
CPC ..... A24F 15/12; A24F 15/16; A24F 15/14; A24F 15/00; A24F 15/04; A24F 15/06; B65D 85/10; B65D 85/1009; B65D 85/1036; B65D 85/1045; B65D 85/1054; B65D 5/38
USPC ..... 206/252, 254, 249, 250, 255, 251
See application file for complete search history.

(56) References Cited

U.S. PATENT DOCUMENTS 1,155,688 A 10/1915 Shearman et al.
1,615,545 A 1/1927 Larson et al.

(Continued)

FOREIGN PATENT DOCUMENTS

FR 2499947 A3 8/1982
FR 2876664 A1 4/2006

(Continued)

OTHER PUBLICATIONS

International Search Report and Written Opinion dated Jun. 12, 2013 from counterpart application No. PCT/IB2013/051708.

(Continued)

*Primary Examiner* — Steven A. Reynolds
(74) *Attorney, Agent, or Firm* — Timothy J. Klima; Shuttleworth & Ingersoll, PLC

(57) ABSTRACT

A packet for tobacco products, includes a mobile container to receive the tobacco products, and a box-shaped body, housing the mobile container such that the mobile container can slide relative to the box-shaped body between a position in which the mobile container is completely inserted in the box-shaped body and a position in which a part of it is extracted from the box-shaped body. Each mobile container includes an inner container housing a group of tobacco products, and an outer container housing the inner container slidably in parallel with axes of the tobacco products, thus allowing the inner container to slide between a retracted position, and an extracted or raised position, in which the inner container is positioned close to a top wall of the outer container and a portion of a tobacco product is accessible through an opening in the outer container.

17 Claims, 16 Drawing Sheets

(56) References Cited

U.S. PATENT DOCUMENTS

| | | | | |
|---|---|---|---|---|
| 1,807,936 | A | 6/1931 | Saunders et al. | |
| 1,897,702 | A * | 2/1933 | Lewnes | A24F 15/14 206/255 |
| 2,929,542 | A * | 3/1960 | O'Gorman | B65D 5/6688 206/268 |
| 3,108,711 | A | 10/1963 | Anton | |
| 4,534,463 | A | 8/1985 | Bouchard | |
| 4,559,758 | A | 12/1985 | Gamberini | |
| 4,789,059 | A * | 12/1988 | Kim | B65D 85/1081 206/246 |
| 5,080,227 | A * | 1/1992 | Focke | B65D 5/38 206/273 |
| 5,205,402 | A * | 4/1993 | Maeda | A24F 15/14 206/250 |
| 6,450,329 | B1 * | 9/2002 | Draghetti | B31F 1/247 206/252 |
| 7,721,881 | B2 | 5/2010 | He | |
| 7,992,708 | B2 * | 8/2011 | Hein | B65D 85/1054 206/249 |
| 8,225,931 | B2 * | 7/2012 | Wharton | B65D 5/38 206/462 |
| 8,584,844 | B2 * | 11/2013 | Tearle | B65D 85/1036 206/256 |
| 2008/0185303 | A1 * | 8/2008 | He | B65D 85/1009 206/249 |
| 2009/0038966 | A1 * | 2/2009 | Ghini | B65D 5/5213 206/268 |
| 2011/0062037 | A1 | 3/2011 | Bertuzzi et al. | |
| 2011/0232236 | A1 | 9/2011 | Chatelain et al. | |
| 2013/0140201 | A1 * | 6/2013 | Ghini | B65D 5/38 206/267 |
| 2013/0248392 | A1 * | 9/2013 | Roila | B65D 5/646 206/255 |

FOREIGN PATENT DOCUMENTS

| | | | |
|---|---|---|---|
| IT | 1169163 | B | 5/1987 |
| WO | 2004063032 | A2 | 7/2004 |
| WO | 2012025757 | A1 | 3/2012 |

OTHER PUBLICATIONS

International Search Report and Written Opinion dated Jun. 12, 2013 from counterpart App No. PCT/IB2013/051741.

* cited by examiner

PACKET FOR TOBACCO PRODUCTS

This application is the National Phase of International Application PCT/IB2013/051708 filed Mar. 4, 2013 which designated the U.S. and that International Application was published under PCT Article 21(2) in English.

This application claims priority to Italian Patent Application No. BO2012A000112 filed Mar. 7, 2012, which application is incorporated by reference herein.

TECHNICAL FIELD

This invention relates to a packet for tobacco products with facilitated extraction of the tobacco products.

Hereinafter in this description, reference is made to tobacco products consisting of cigarettes, without thereby restricting the scope of the invention.

BACKGROUND ART

Several types of cigarette packets present on the market have an outer container which slidably houses an inner container which accommodates a group of cigarettes.

The inner container can slide inside the outer container between a closed position in which the inner container is completely inserted in the outer container, and an open position, in which the inner container is partly extracted from the outer container.

Some embodiments of hard cigarette packets which slide open by a translating movement are described in patent documents FR2499947A1, U.S. Pat. No. 4,534,463A1, U.S. Pat. No. 5,080,227A1 and IT116916 B.

Often, the inner container applies a certain amount of lateral compression on the group of cigarettes inside it. When the cigarette packet is new and the group of cigarettes it contains is whole, the lateral compression applied to the group of cigarettes may be relatively high and may make it quite difficult to take out the first cigarette from the group of cigarettes owing to the friction between the first cigarette itself and the cigarettes around it.

One solution which has been proposed to make it easier to take out the first cigarette, and if necessary also other cigarettes, from the group, is to couple to at least one cigarette in the group a pull-out tape with one end which protrudes from the top wall of the group of cigarettes and which is designed to be gripped and pulled in order to lift out the cigarette.

These pull-out tapes, however, usually require the inner end of them, opposite the end to be gripped, to be glued to one wall of the inner container. This constitutes a major disadvantage since the inner wrappings of cigarette packets have always been left free of glue because glue in contact with or close to the cigarettes may give off volatile substances which are absorbed by the cigarettes and cause an unwanted alteration of the flavour and/or taste of the cigarette tobacco.

DISCLOSURE OF THE INVENTION

This invention has for an aim to provide a packet for tobacco products with facilitated extraction of the tobacco products and which overcomes the above mentioned disadvantages.

The invention accordingly provides a packet for tobacco products with facilitated extraction of the tobacco products as described in the appended claims.

BRIEF DESCRIPTION OF DRAWINGS

The invention is described below with reference to the accompanying drawings, which illustrate a non-limiting embodiment of it, and in which.

DETAILED DESCRIPTION OF THE PREFERRED EMBODIMENTS OF THE INVENTION

Figure 1:
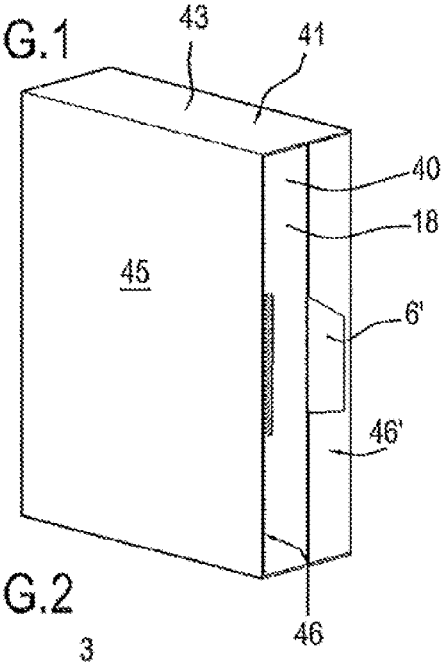
FIGS. 1 and 2 are perspective views of a packet for tobacco products according to this invention, in two different working situations.
Figure 2:
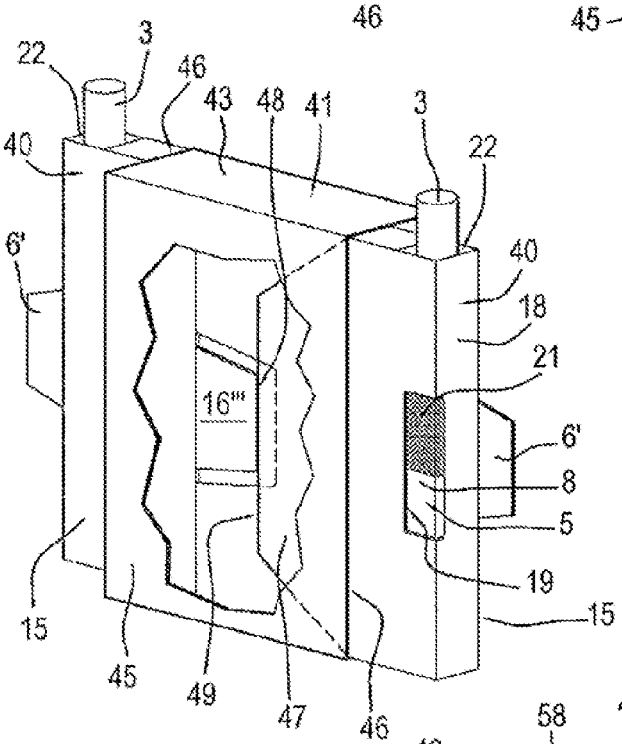

The numeral 1 in FIGS. 1 and 2 denotes in its entirety a packet for tobacco products, in particular cigarettes, and consisting of a hard packet of the slide-open type.

Hereinafter in this description, reference is made to tobacco products consisting of cigarettes, without thereby restricting the scope of the invention.

The packet 1 comprises a pair of mobile containers 40, each of which receives a group 2 of cigarettes 3 (see also FIG. 6), and an outer box-shaped body 41, which slidably houses the containers 40 whose respective larger side walls 15 are positioned side by side; in such a way that each container 40 can slide relative to the box-shaped body 41 between a closed position (illustrated in FIG. 1), where the containers 40 are completely inserted in the box-shaped body 41 and an open position (illustrated in FIG. 2), in which a part of the mobile containers 40 is extracted from the box-shaped body 41. As shown in FIG. 2, the mobile containers 40 are able to slide out of the box-shaped body 41, in respective opposite directions parallel with each other, through respective side portions of the box-shaped body 41 which are opposite one another.

It is important to observe that the two mobile containers 40 slide relative to the box-shaped body 41 independently of each other and it is therefore possible that only one of the containers 40 is in the open position or that both of the containers 40 are in the open position (as illustrated in FIG. 2).

In the description which follows, the term "vertical" (or similar terms) will be used, for explanatory purposes, to describe the position adopted by the packet 1 when the cigarettes 3 inside it, for easier extraction, are positioned with their axes vertical and the zones where the cigarettes 3 themselves are extracted from the packet 1 are located at the top of the packet 1. Similarly, the terms "upper" and "lower" (and like terms, such as "top" and "bottom") will be used to designate the corresponding portions of the packet 1 when is in the vertical position.

As illustrated, in particular in FIG. 3, the box-shaped body 41 has the shape of a parallelepiped and has a bottom wall 42 at its lower end, a top wall 43 at its upper end, a lateral surface 44 which is delimited above and below by its bottom and top walls 42 and 43, respectively. The lateral surface 44 is also defined by two larger side walls 45 which are positioned vertically, opposite and parallel to each other, and which are joined to each other, above and below, by the bottom and top walls 42 and 43.

Figure 3:
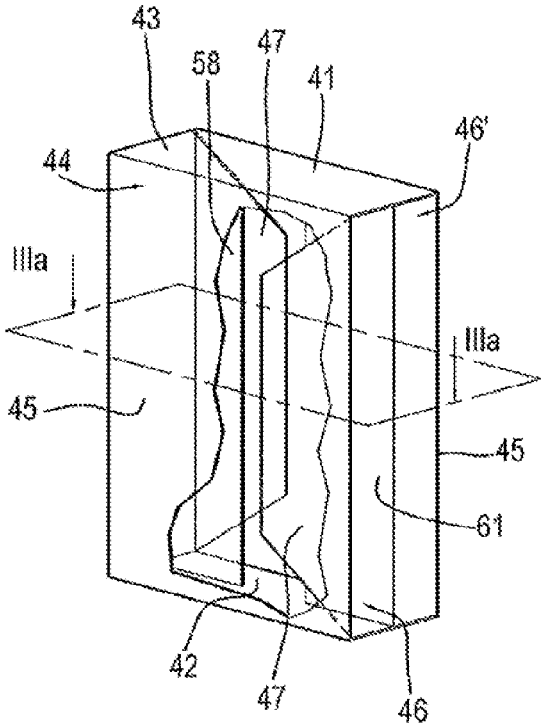
FIG. 3 is a perspective view of a box-shaped body forming part of the packet of FIGS. 1 and 2, in the closed condition.

Two horizontally opposite portions of the box-shaped body 41 are defined by corresponding openings 46, extending preferably (and as shown in FIGS. 1-3) right across the respective smaller lateral faces 46' of the box-shaped body 41. The openings 46 are designed to allow the mobile containers 40 to move between the aforementioned positions where they are closed (FIG. 1) and open (FIG. 2).

As shown in FIGS. 4-7, in the context of each mobile container 40, the group 2 of cigarettes 3 is contained in a hard inner container 5 which is housed in such a way that it can slide within a hard outer container 6, made of cardboard or the like, vertically in both directions with a straight vertical movement between a retracted position (illustrated in FIG. 4), where the inner container 5 is at its lowermost position inside the outer container 6 and a raised or cigarette extraction position (illustrated in FIG. 5), where the inner container 5 is at its uppermost position inside the outer container 6 and keeps one cigarette 3 in a partly extracted position (upwardly) from the inner container 5.

Integral with a vertical portion substantially half way along the edge of each outer container 6 and situated, in the context of the packet 1 in the closed condition, substantially at the centre of the opening 46 and adjacent to the other outer container 6 there is a grip element comprising a wing 6' which projects outwards from the body of the packet 1 so that, in use, it can be gripped and pulled manually in order to extract the respective container 6 partly from the box-shaped body 41.

The inner container 5 (FIG. 6) has the shape of a parallelepiped, with a substantially "cupped" form, and has a bottom wall 7, two parallel larger side walls 8, which are parallel and opposite to one another, and two smaller parallel side walls 9 and 10, which are interposed between the larger side walls 8. The open upper end 11 of the inner container 5 defines, in the proximity of the smaller side wall 10, a zone 12 for extracting one cigarette 3 at a time and through which, when the inner container 5 is in the "raised" position (whose features and purposes are described below) it is possible to extract a cigarette 3 from the packet 1.

Figure 7:
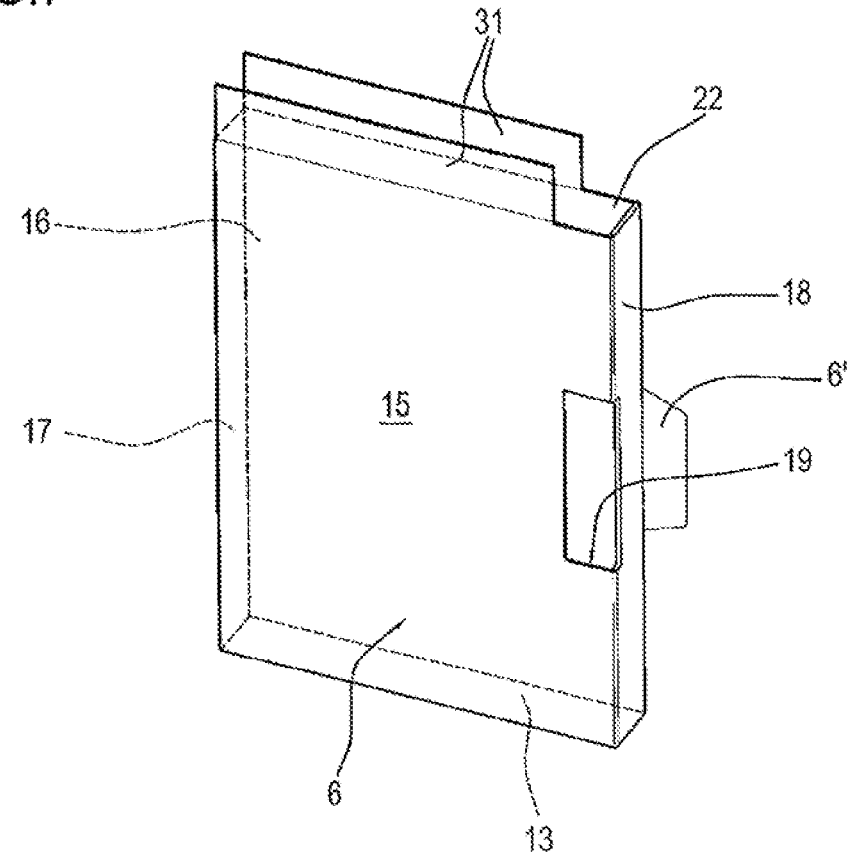

As illustrated, in particular in FIG. 7, the outer container 6 also has the shape of a parallelepiped and has a bottom wall 13 at its lower end, a top wall 14 at its upper end, two larger side walls 16 and 16 which are parallel and opposite to each other and which are located, in FIG. 7, at the front and back, respectively, and two smaller side walls 17 and 18 (which are positioned on the left and on the right, respectively).

In a zone substantially half way along the edge where the side walls 15 and 18 of the outer container 6 meet, there is an opening comprising a slot 19 made in the blank 20 which makes up the outer container 6 itself and through which a smoker can touch a front zone 21 of the inner container 5. The shape and size of the slot 19 are such as to allow the smoker to apply, through the slot 19 itself, a pushing action on the front zone 21 of the inner container 5 in such a way as to move it vertically in both directions, making it slide within the outer container 6 between the aforementioned retracted and raised positions. It should be noted that in variant embodiments, not illustrated, of the packet 1, the slot 19 might be made in only one of the larger side walls 15 (preferably the front one), or one of the smaller side walls 18.

In order to facilitate the manual pushing action applied by the smoker on the front zone 21 of the inner container 5, the exposed surface of the front zone 21 may be provided with knurling or other roughening feature.

The upper wall 14 of the outer container 6 has an opening 22 which is substantially square in shape, vertically aligned with the zone 12 for extracting the cigarettes 3 and therefore placed substantially over a lateral end portion of the inner container 5 on the right-hand side in FIGS. 1 and 2 and facing the slot 19 of the outer container 6.

The packet 1 is provided with stop means which are designed to limit the sliding of the mobile containers 40 relative to the box-shaped body 41 in such a way as to prevent the selfsame mobile containers 40 from being pulled out of the box-shaped body 41 completely. The stop means are defined, as regards the box-shaped body 41, by two substantially trapezoidal tabs 47 which project from the larger side walls 45 of the box-shaped body 41 towards the inside of the box-shaped body 41 itself and which are located close to respective opposite openings 46 of the box-shaped body 41. More specifically, as shown in particular in FIG. 3, when the packet 1 is closed, each tab 47 abuts one wall 15 of a mobile container 40 substantially at the zone of the selfsame wall 15 that comes out of the box-shaped body 41 when the mobile container 40 is partly extracted from the box-shaped body 41 itself. Also, preferably, each tab 47 is glued to the adjacent larger side wall 45 of the box-shaped body 41.

The stop means are defined, as regards each mobile container 40, by a substantially trapezoidal tab 16" which projects outwards from a respective larger side wall 15 of the mobile container 40 and which is positioned to face a larger side wall 45 of the box-shaped body 41. As shown also in FIG. 9, the tab 16''' forms part of the respective larger side wall 15 of the outer container 6 (and hence of the mobile container 40) and is defined by an incision 16" cut through the larger side wall 15.

As shown in FIG. 3, the tab 16''' of each mobile container 40 is positioned in such a way that its vertical edge 48 comes into contact with a corresponding vertical edge 49 of the corresponding tab 47 of the box-shaped body 41 when the mobile container 40 is slid out of the box-shaped body 41 and thus prevents the mobile container 40 from coming out of the box-shaped body 41.

On the other hand, if the tabs 47 are not glued to the adjacent larger side walls 45 of the box-shaped body 41, the mobile container 40 is prevented from coming out of the box-shaped body 41 by the fact that the respective tab inserted into the space between the tab 47 adjacent to it and the larger side wall 45 of the box-shaped body 41 alongside the tab 47.

Figure 8:
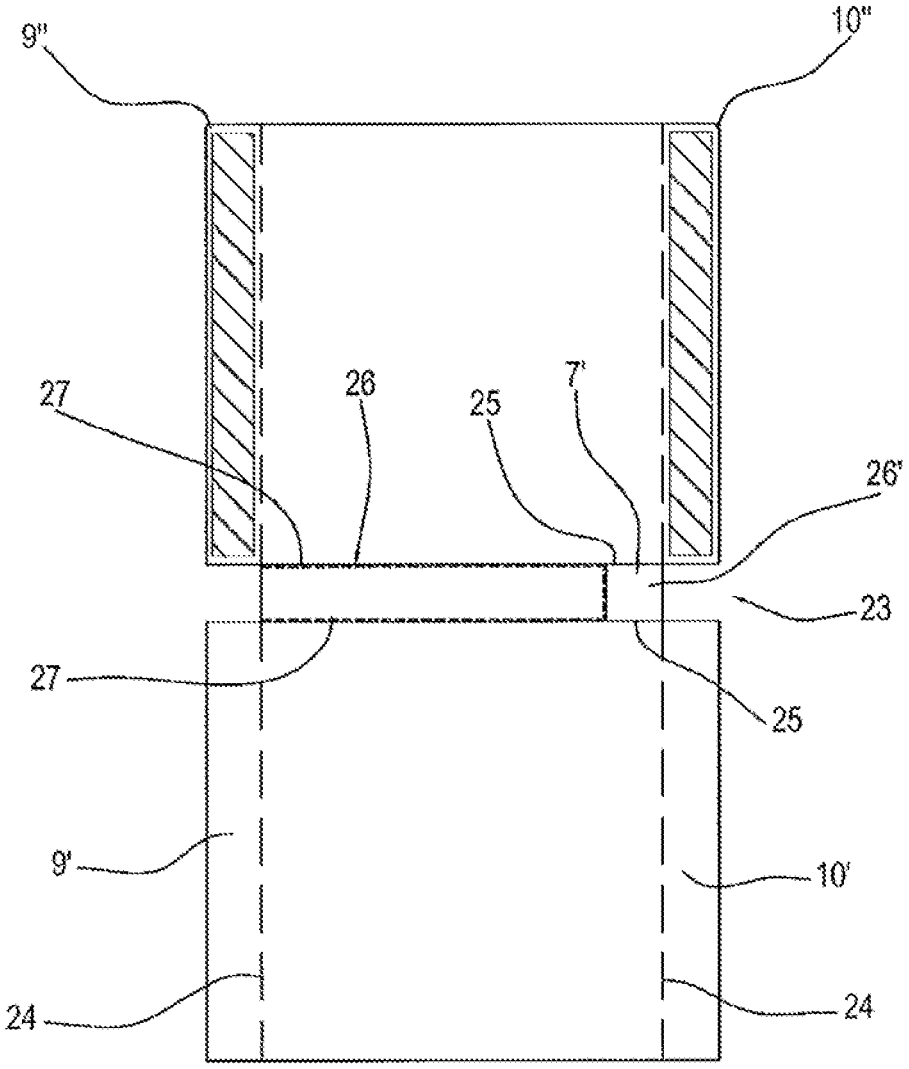
FIGS. 8 and 9 are plan views showing two blanks used to make the containers of FIGS. 6 and 7, respectively.
Figure 9:
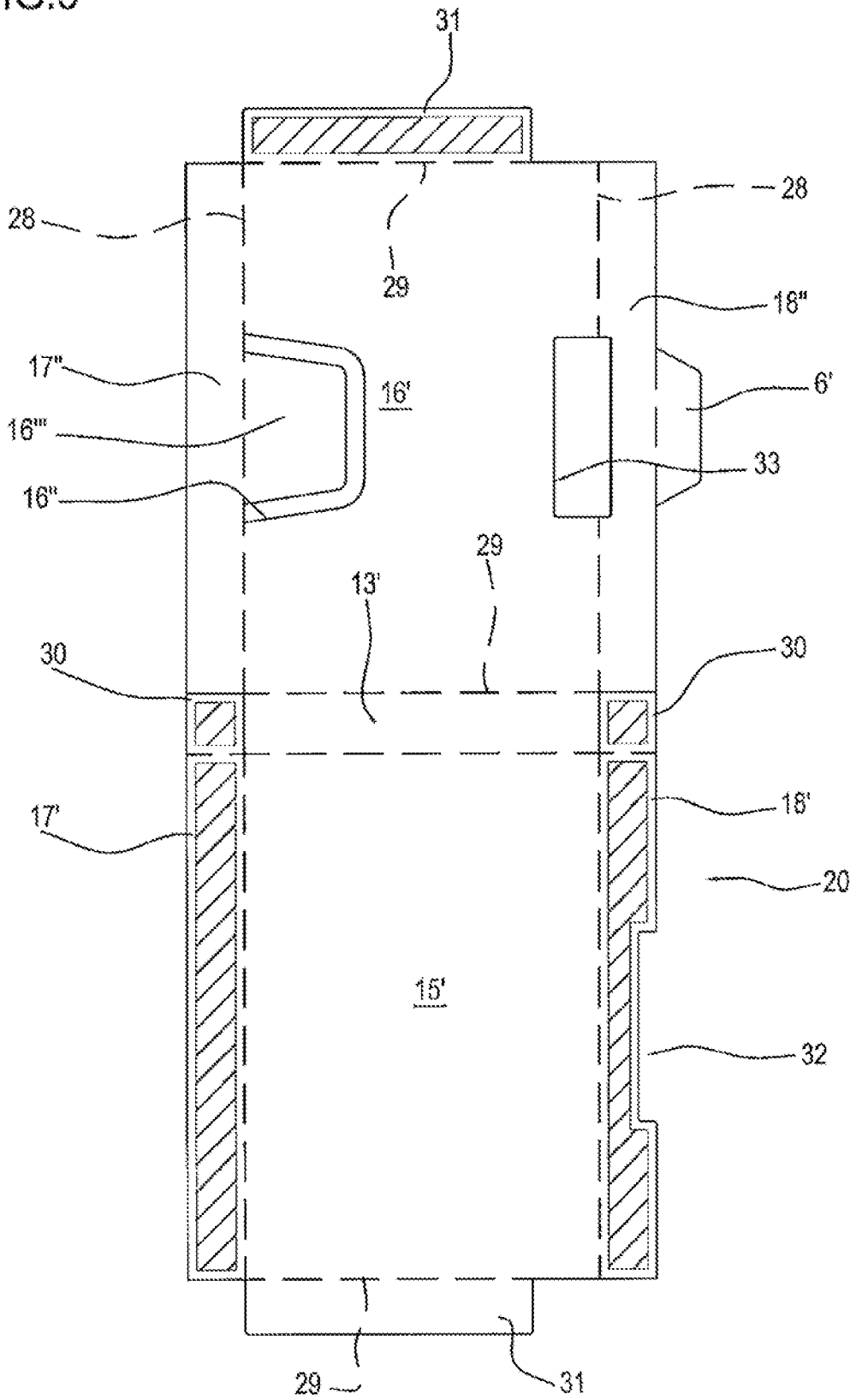

The containers 5 and 6 of each mobile container 40 of the cigarette packet 1 are obtained from corresponding blanks 23 and 20, respectively, illustrated in FIGS. 8 and 9, respectively. Each of the blanks 23 and 20 comprises a plurality of elements, which, where possible, are denoted by primed reference numerals which are the same as the unprimed reference numerals denoting the corresponding elements of the respective container 5 or 6.

With reference to FIG. 8, the blank 23 has two longitudinal lines of weakness 24 and two transversal lines of weakness 25 which define (from the bottom up in the figure), between the two longitudinal lines of weakness 24, a panel 8' constituting one larger side wall 8, a panel T constituting the bottom wall 7 and a panel 8' constituting the other larger side wall 8.

Figure 5:
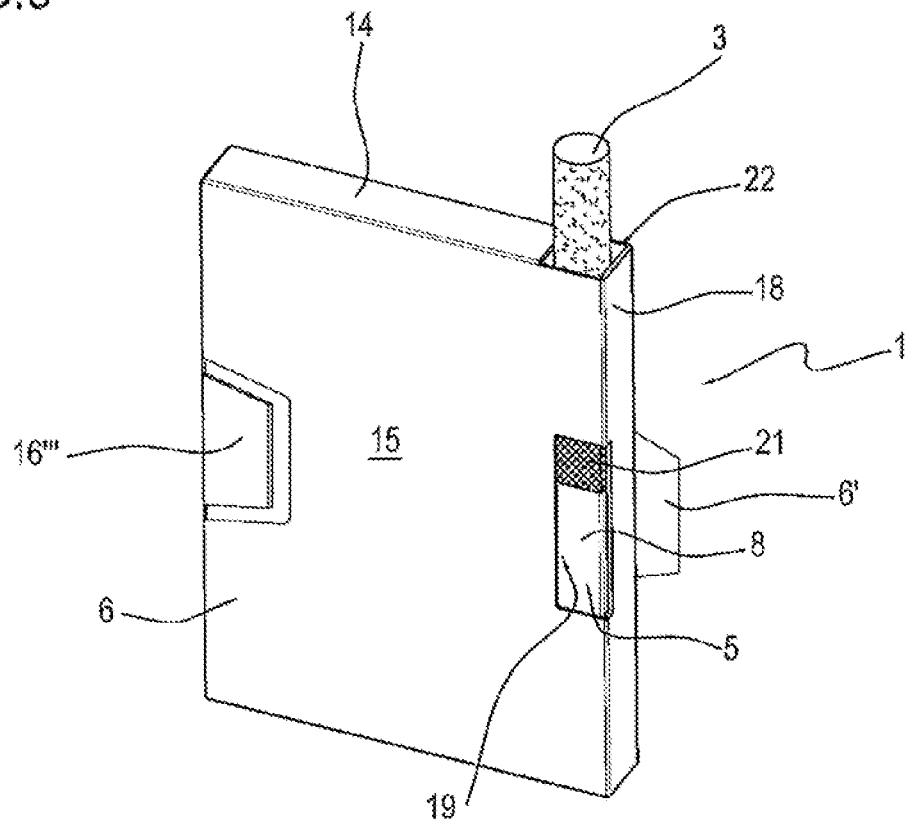

The panel 8", located at the bottom in FIG. 5, has a pair of side flaps 9', 10', left and right, respectively, which constitute an inner part of the smaller side walls 9, 10', are located on opposite sides of the panel 8' adjacent to them and are separated from the panel 8' by the longitudinal lines of weakness 24. Similarly, the panel 8', located at the top in FIG. 8, has a pair of side flaps 9", 10", left and right, respectively, which constitute an outer part of the smaller side walls 9, 10', are located on opposite sides of the panel 8' adjacent to them and are separated from the panel 8' by the longitudinal lines of weakness 24.

The panel 7' constituting the bottom wall 7, is provided, on the part of it on the left in FIG. 8, with a line of weakness 26 which is substantially in the shape of a "U" with concavity facing towards the left and having two opposite long sides 27 coinciding with respective portions of the two longitudinal lines of weakness 25 which delimit two opposite sides of the panel 7' itself.

The line of weakness 26 extends towards the right of the panel 7' to a distance from that end which is just a little longer than the diameter of a cigarette 3. The portion of the panel 7' between the right-hand end of the panel 7' itself and the line of weakness 26 will hereinafter be referred to as "supporting portion", denoted by the reference numeral 26'.

With reference to FIG. 9, the blank 20 has two longitudinal lines of weakness 28 and a plurality of transversal lines of weakness 29 which define (from the bottom up in the figure), between the two longitudinal lines of weakness 29, a panel 15' constituting one larger side wall 15, a panel 13' constituting the bottom wall 13 and a panel 16' constituting the other larger side wall 16.

The panel 15' has a pair of side flaps 17' and 18', left and right, respectively, in FIG. 9, which are located on opposite sides of the panel 15' itself, are separated from the panel 15' by the longitudinal lines of weakness 28, are substantially rectangular in shape and constitute an outer portion of the walls 17 and 18, respectively. Similarly, the panel 16' has a pair of side flaps 17" and 18", left and right, respectively, in FIG. 9, which are located on opposite sides of the panel 16', are separated from the panel 16' itself by the longitudinal lines of weakness 28, are substantially rectangular in shape and constitute an inner portion of the walls 17 and 18, respectively. Integral with a substantially median portion of one vertical side of the flap 18" on the right in FIG. 9 there is a substantially trapezoidal wing 6' which projects towards the outside of the blank 20.

In a vertically median portion of the panel 16' bordering on the flap 17" there is an incision 16" which substantially follows the shape of the smaller base and sides of an isosceles trapezium whose larger base coincides with a portion of the longitudinal line 28 which separates the panel 16' itself from the flap 17". The portion of the blank 20 enclosed within the incision 16" defines the substantially trapezoidal tab 16'" of the mobile container 40.

The horizontal sides of the side flaps 17' and 18' located at the top in FIG. 9 are connected, by end portions of the transversal line of weakness 29 which separates the panel 13' from the panel 15', to two flaps 30 extending towards, and almost touching, the flaps 17" and 18", respectively. Each of the panels 15' and 16' has a horizontal side, located respectively at the bottom and top in FIG. 9, and connected to a respective flap 31 located on the opposite side with respect to the panel 13' and separated from the respective panel 15', 16' by a transversal line of weakness 29.

The transversal dimension of the flaps 31 in the direction of the transversal lines of weakness 29 is smaller than the transversal dimension of the panels 15' and 16', and the flaps 31 are positioned relative to the respective panels 15' and 16' in such a way that they are clear of respective lateral portions of the panels 15' and 16' situated on the right in FIG. 9 and whose width is just larger than the diameter of a cigarette 3.

The side flap 18' connected to the edge of the panel 15' situated on the right in FIG. 9 is provided, at a longitudinally median zone of it, with a recess 32 which runs parallel to the longitudinal direction of extension of the blank 20 and whose depth is substantially equal to half the width of the flap 18' itself.

The zone of connection between the panel 16' and the side flap 18" situated on the right in FIG. 9 is crossed at a longitudinally median part of it, by a substantially rectangular elongate slot 33 which runs parallel to the longitudinal direction of extension of the blank 20, whose length is substantially equal to that of the recess 32 and whose width, at the portion of it corresponding to the side flap 18", is equal to that of the recess 32, whilst at the portion of it situated on the panel 16' is preferably greater than the width of the recess 32, being substantially equal to 7-10 mm.

It should be noted that in variant embodiments of the invention not illustrated, the slot 33 might be situated at any position in the right-hand zone of the panel 16', and it might be of any shape and size, in any case different from the shape and size of the slot 33 shown in FIG. 9.

Figure 10:
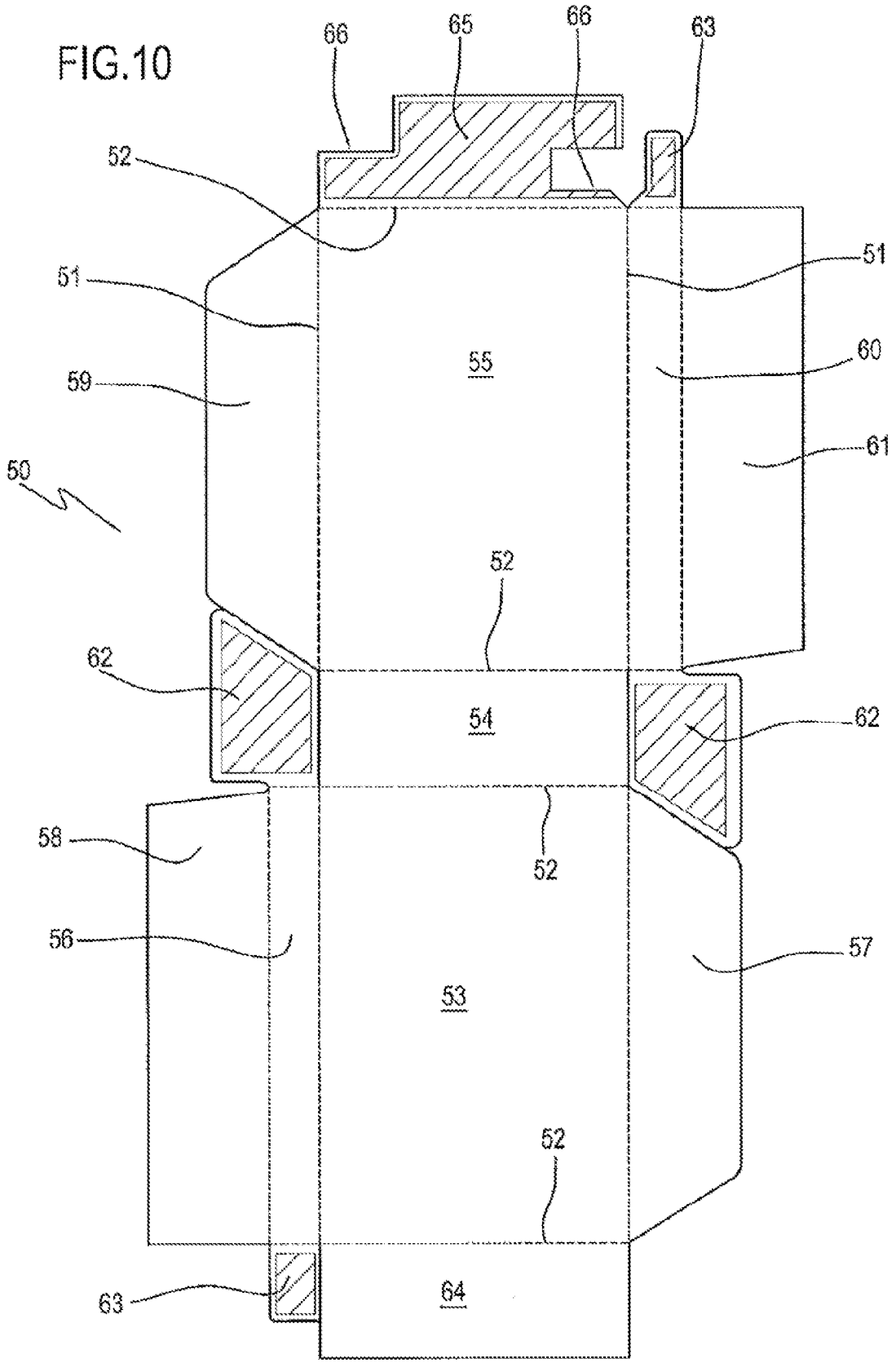
FIG. 10 is a plan view of a blank used to make the box-shaped body of FIG. 3.

With reference to FIG. 10, the blank 50 from which the box-shaped body 41 is obtained has two longitudinal lines of weakness 51 and a plurality of transversal lines of weakness 52 which define (from the bottom up in the figure), between the two longitudinal lines of weakness 51, a panel 53 constituting one larger side wall 45 of the box-shaped body 41, a panel 54 constituting the bottom wall 42 and a panel 55 constituting the other larger side wall 45.

The panel 53 has a pair of side flaps 56 and 57, left and right, respectively, in FIG. 10, which are located on opposite sides of the panel 53 itself, are separated from the panel 53 by the longitudinal lines of weakness 51, and have, respectively, a substantially rectangular shape (the flap 56) and the shape of an isosceles trapezium (the flap 57). The flap 57 constitutes one of the aforementioned tabs 47. Integral with the flap 56 situated on the left in FIG. 10 is the right-hand longitudinal side of a substantially rectangular wall 58.

Similarly, the panel 55 has a pair of side flaps 59 and 60, left and right, respectively, in FIG. 10, which are located on opposite sides of the panel 55, are separated from the panel 55 itself by the longitudinal lines of weakness 51, and have, respectively, a substantially rectangular shape (the flap 59) and the shape of an isosceles trapezium (the flap 60). The flap 59 constitutes one of the aforementioned tabs 47, integral with the flap 60 situated on the right in FIG. 10 is the left-hand longitudinal side of a substantially rectangular wall 61.

The horizontal sides of the side flaps 56 and 60 located, respectively, at the top and bottom in FIG. 10 are connected, respectively, by end portions of respective transversal line of weakness 52, to two flaps 62 extending towards, and almost touching, the flaps 59 and 57, respectively.

The horizontal sides of the side flaps 56 and 60 located, respectively, at the bottom and top in FIG. 10 are connected, respectively, by end portions of respective transversal line of weakness 52, to two flaps 63 extending downwards and upwards, respectively.

Each of the panels 53 and 55 has a horizontal side, located respectively at the bottom and top in FIG. 10, and connected to a respective flap 64, 65 located on the opposite side with respect to the panel 54 and separated from the respective panel 53, 55 by a transversal line of weakness 52. The transversal dimension of the flaps 64 and 65 in the direction of the transversal lines of weakness 52 is equal to the transversal dimension of the panels 53 and 56. The flap 65 located at the top in FIG. 10 has two indentations 66 whose function, when the box-shaped body 41 is assembled, is to receive the flaps 63 in such a way that the flaps 63 themselves do not overlap portions of the flaps 64 and 65.

In the blanks 23, 20 and 50 shown in FIGS. 8, 9 and 10, the parts where glue must be applied in order to assemble the containers 5 and 6 and the box shaped body 41 are represented as hatched areas.

The inner container 5 is assembled by folding the panels 8 squarely relative to the panel 7', towards each other, about the transversal lines of weakness 25 which join them to the panel 7' itself. The side flaps 9' and 10' are then folded squarely about the longitudinal lines of weakness 24 which join them to the panel 8', in such a way that they cover the space between the two panels 8', and the side flaps 9" and 10" are in turn folded squarely over the respective side flaps 9' and 10' which have already been folded. The glue on the blank 23, as specified above, keeps the inner container 5 in the shape thus obtained.

The outer container 6 is assembled in a similar way to the inner container 5, since the panels 15' and 16' are folded squarely about the transversal lines of weakness 29 which join them to the panel 13', the side flaps 17" and 18" are folded squarely about the longitudinal lines of weakness 28, which join them to the panel 16', in such a way that they cover the space between the two panels 16', the flaps 30 are folded squarely about the transversal lines of weakness 29, which join them to the respective flaps 17' and 18, and are placed over the panel 13', and the side flaps 17' and 18' are folded squarely over the respective side flaps 17" and 18" which have already been folded. These operations are performed by shaping the outer container 6 around the inner container 5 already erected and housing inside it a row 4 of cigarettes 3 When the outer container 6 has been completed, the flaps 31 are folded squarely over each other in such a way as to close the outer container 6. The glue on the blank 20, as specified above, keeps the outer container 6 in the shape thus obtained.

It should be noted that on the face of it which is on the outside of the inner container 5, the portion of the panel 7' of the inner container 5 enclosed within the line of weakness 26 is provided with glue which, after the containers 5 and 6 have been assembled, causes it to adhere to the panel 13' of the outer container 6.

As a result, the blank 23 is easy to handle while the inner container being made, since its bottom panel T' connects the panels 8' to each other for as long as the line of weakness 26 remains intact, thus giving the blank 23 good shape stability and sufficient rigidity. Once the packet 1 has been completed, the first time an inner container 5 is made to slide upwards within the respective outer container 6, as mentioned above and as will be explained in more detail below, the line of weakness 26 is torn, the inner container 5 comes completely free of the outer container 6 and the walls 8 of the inner container 5 remain connected to each other only by the zone of the panel 7' outside of the line of weakness 26. From this moment on, the inner container 5 is open at the bottom except only the zone of the panel T outside the line of weakness 26, that is to say, except the supporting portion 26' of the wall 7.

In other words, according to the above, the bottom wall of the inner container 5 is defined by a bottom wall 7 in which a tearable line of weakness 26 is made which delimits an area of the selfsame bottom wall 7. A portion of the bottom wall 7 outside that area defines the supporting portion 26' and the area is connected by adhesive to the bottom wall 13 of the outer container 6.

To assemble the box-shaped body 41, the flaps 62 and 63 are folded squarely about the transversal lines of weakness 52 which join them to the flaps 56 and 60. The side flaps 56 and 57 are folded—the former squarely and the latter by 180°—about the longitudinal lines of weakness 51 which join them to the panel 53, and the side flaps 59 and 60 are folded—the former by 180° and the latter squarely—about the longitudinal lines of weakness 51 which join them to the panel 55. The walls 58 and 61 are then folded squarely about the lines of weakness which join them to the flaps 56 and 60, respectively. The panels 53 and 55 are folded squarely about the transversal lines of weakness 52 which join them to the panel 54 constituting the bottom wall 42 of the box-shaped body 41, and at the same time, the flaps 62 are placed over respective portions of the panel 54 inside the box-shaped body 41 itself. To complete the box-shaped body 41, the flap 65 is folded squarely about the transversal line 52 which connects it to the panel 55, and the flap 64 is folded squarely about the transversal line 52 which connects it to the panel 53 and is placed over the flap 65 and over the flaps 63.

Figure 3A:
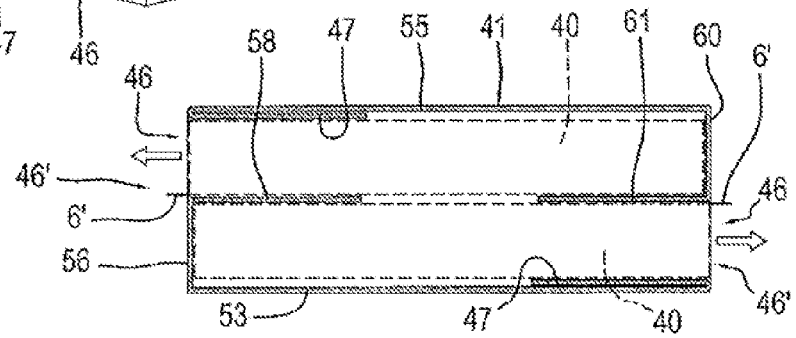
FIG. 3*a* shows a schematic transverse cross section of the box-shaped body of FIG. 3.
Figure 4:
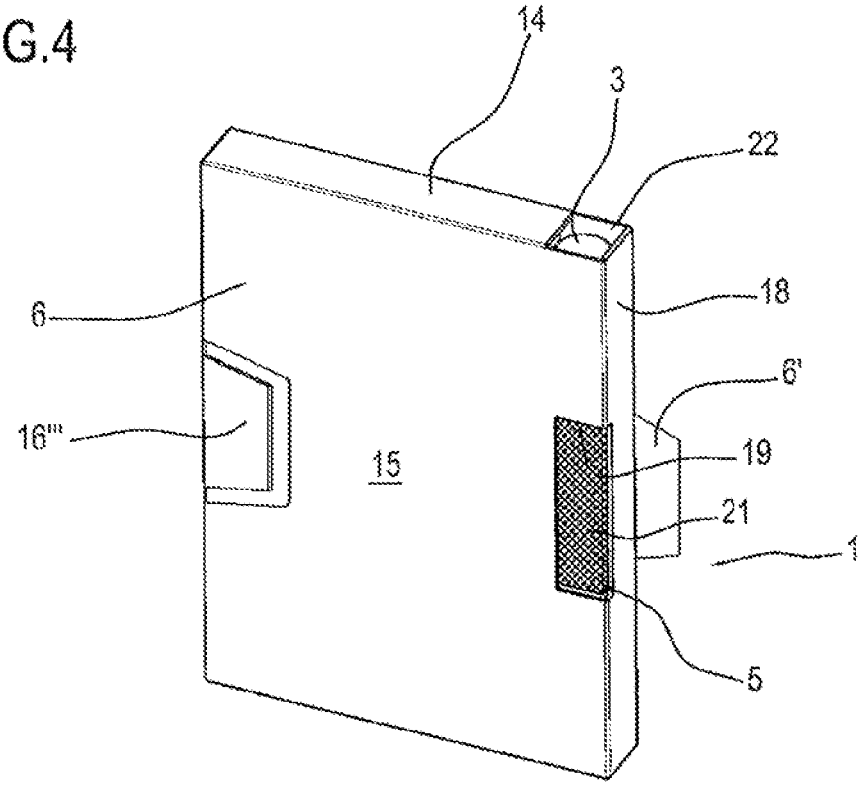
FIGS. 4 and 5 are perspective views of a mobile container forming part of the packet for tobacco products of FIGS. 1 and 2, in two different working situations.

The final arrangement of the panels 53 and 55, of the flaps 56, 57, 59 and 60 and of the walls 58 and 61 in the box-shaped body 41 is clearly shown in FIG. 3*a*, which also shows the mobile containers 40 housed in the box-shaped body 41.

The glue on the blank 50, as specified above, keeps the box-shaped body 41 in the shape thus obtained.

In use, according to what is mentioned above, when cigarettes 3 do not need to be extracted from the packet 1, the shape of the packet 1 is that shown in FIG. 1, where the mobile containers 40 are contained wholly within the box-shaped body 41.

To extract a cigarette 3, it is necessary to take one of the mobile containers 40 partly out of the box-shaped body 41, by making it slide relative to the box-shaped body 41 by manually pulling on the tab 6' (FIG. 2). As mentioned above, the mobile containers 40 are prevented from coming out of the box-shaped body 41 completely, or from coming out too far, by the action of the stop means comprising the aforementioned tabs 47 and 16'".

When a mobile container 40 has been slid partly out of the box-shaped body 41, the respective inner container 5 occupies its lowermost retracted position where its bottom wall 7 is in contact with the bottom wall 13 of the outer container 6. Owing to a prior arrangement of the packet 1 with the row 4 of cigarettes 3 lying in a substantially vertical plane and with the axes of the cigarettes 3 horizontal, the cigarettes 3 housed inside the inner container 5 have slid translationally towards the wall 10 of the inner container 5, perpendicularly to their axes. As a result of this sliding, the cigarette 3 closest to the wall 10 of the inner container 5 has moved above the zone of the wall 7 adjacent to the wall 10 itself, that is to say, above the supporting portion 26'.

To take a cigarette 3 out of the packet 1, all the smoker has to do is press a finger on the front zone 21 of the inner container 5 through the slot 19 of the outer container 6 in such a way as to urge the inner container 5 upwards from the retracted position to the raised position and to cause an upper portion of the cigarette 3 resting on the supporting portion 26' of the wall 7 to protrude through the opening 22 of the top wall 14 of the outer container 6.

As specified above, since the bottom of the inner container 5 is open except for the supporting portion 26' of the wall 7, the other cigarettes 3 in the row 4 remain in the lowered position in contact with the bottom wall 13 of the outer container 6.

Once the cigarette 3 protruding partly from the packet 1 has been taken out, the inner container 5 must be returned to the initial retracted position by pressing a finger on the front zone 21 in order to allow another cigarette 3 to move onto the supporting portion 26' of the wall 7, as described above.

After a cigarette has been extracted in the manner described, the mobile container 40 from which the cigarette 3 has been removed is pushed back manually into the box-shaped body 41 and returns to the initial position shown in FIG. 1.

Figure 11:
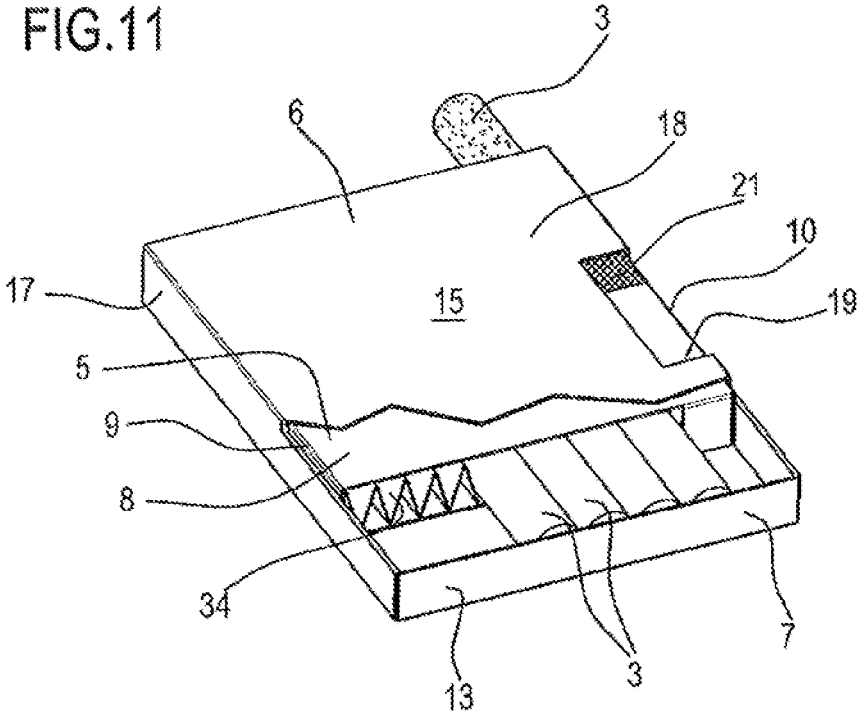
FIG. 11 is a perspective view of a variant embodiment of a part of the packet of the preceding figures.

In order to facilitate the sliding of the cigarettes 3 towards the wall 10 after a cigarette 3 has been taken out, and the return of the inner container 5 to the initial retracted position, it is possible to house inside the inner container 5 an elastic element 34 (FIG. 11) comprising a spring made (for example) by zigzag folding a sheet consisting (for example) of paperboard or plastic material and capable of urging the cigarettes 3 inside the inner container 5 transversely towards the wall 10, that is to say, towards the zone of action of the supporting portion 26'.

Figure 12:
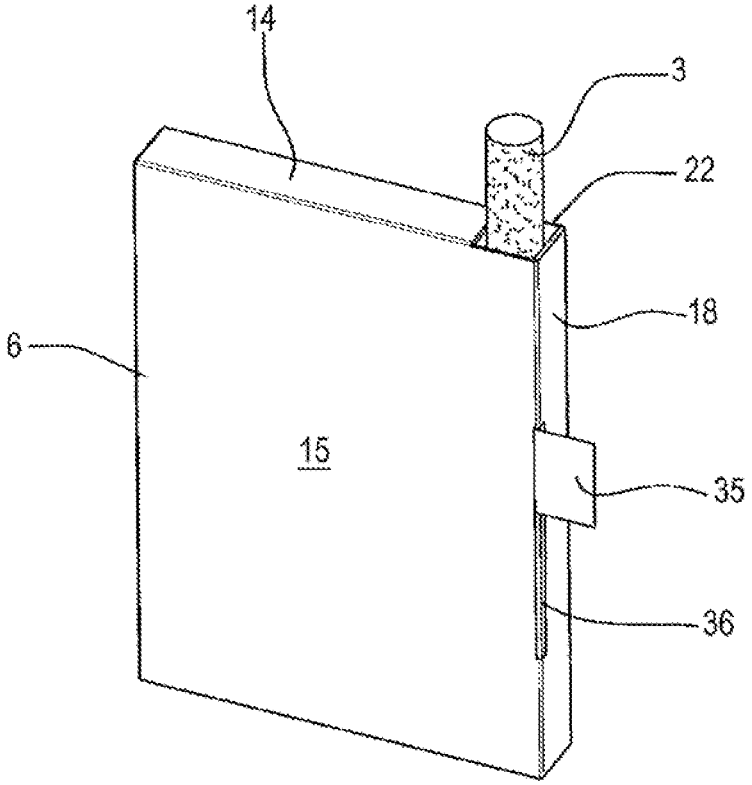
FIG. 12 is a perspective view of a further variant embodiment of a part of the packet of the preceding figures.
Figure 13:
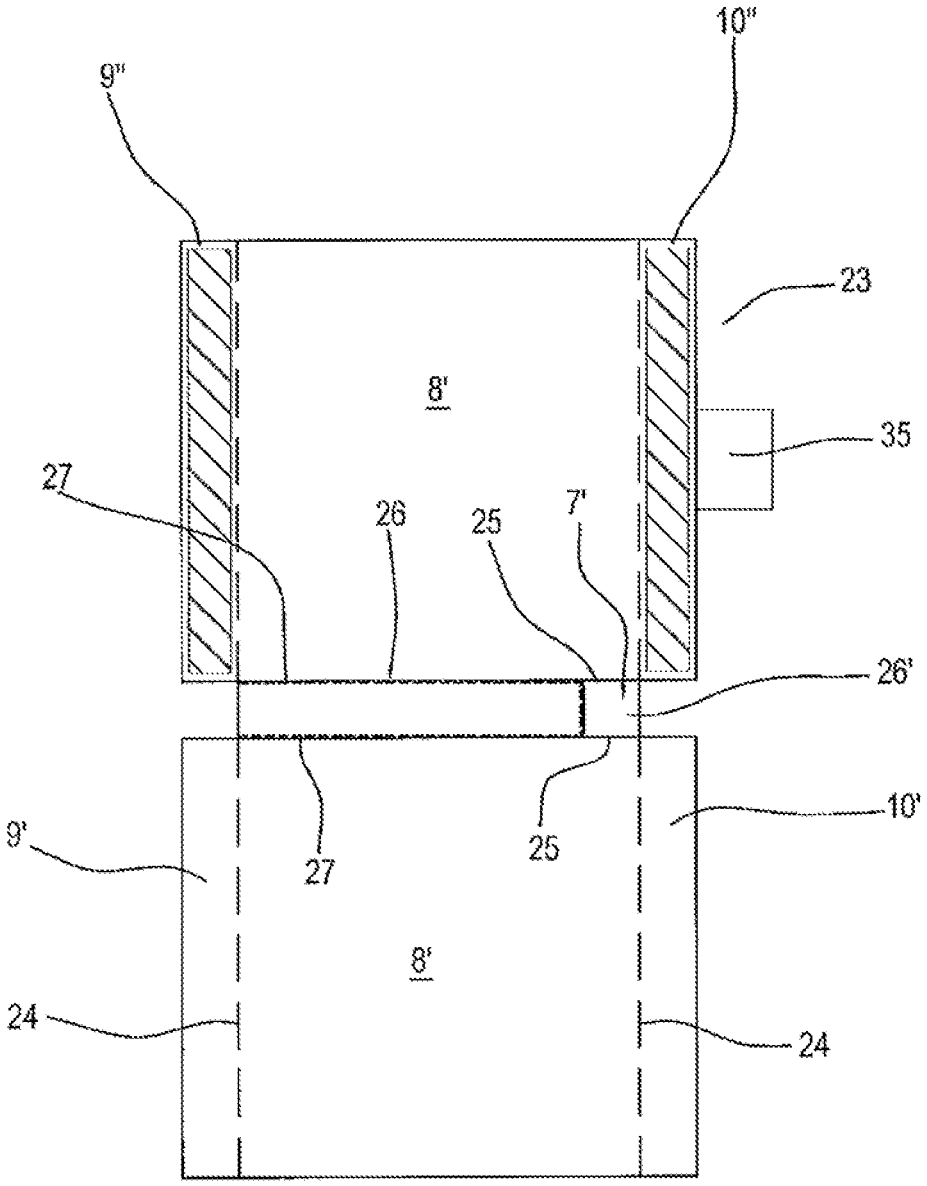
FIG. 13 is a plan view of a blank used to make the variant embodiment of FIG. 12.

FIG. 12 shows a further variant embodiment of the inner container 5, where the sliding of the inner container 5 in both directions between the initial retracted position and the raised position is caused by pulling up or down a grip element comprising a tab 35 which, as shown also in FIG. 13, is integral with a lateral edge of the flap 10' of the blank 23 of the inner container 5 itself and which comes out of the outer container 6 through an opening comprising slit 36 made in the respective blank 20.

Figure 14:
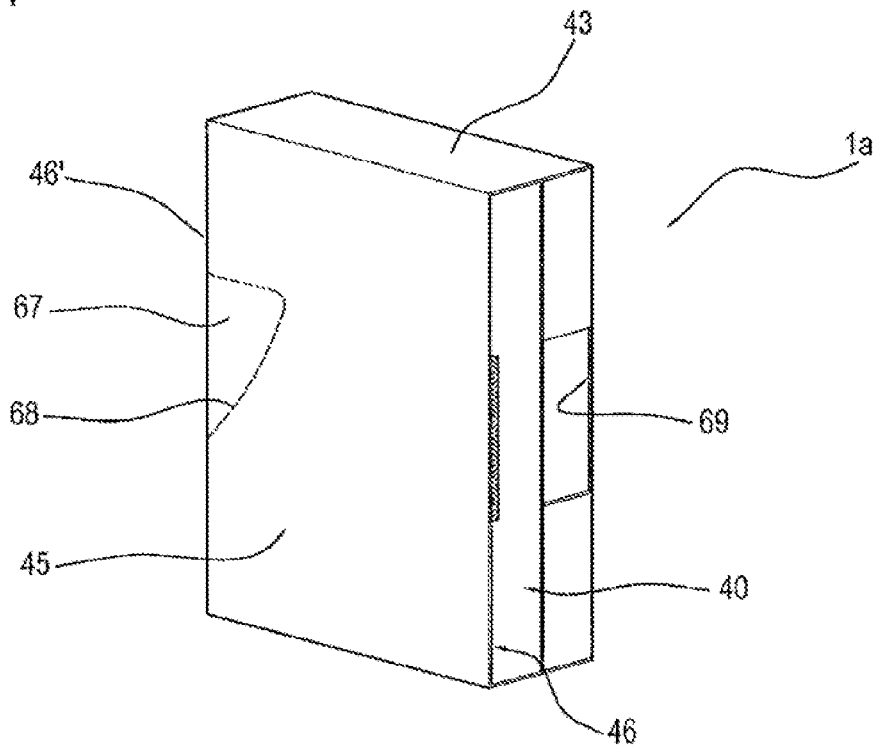
FIGS. 14 and 15 are perspective views of a variant embodiment of the packet for tobacco products of FIGS. 1 and 2, in two respective different working situations.
Figure 15:
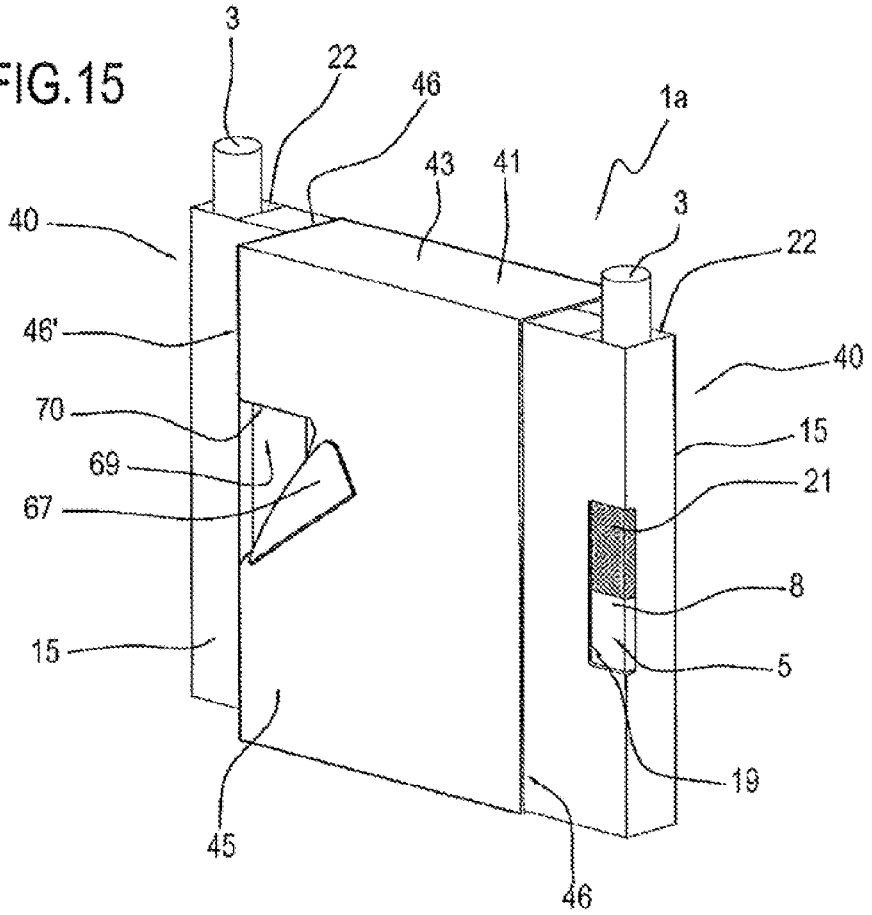

FIGS. 14 and 15 show a packet 1*a* constituting a variant embodiment of the packet 1 of FIGS. 1 and 2.

In the packet 1*a* the outer containers 6 do not have the wing 6' which projects outwards from the body of the packet so that it can be gripped and pulled manually in order to extract the containers 6 partly from the box-shaped body 41.

Figure 16:
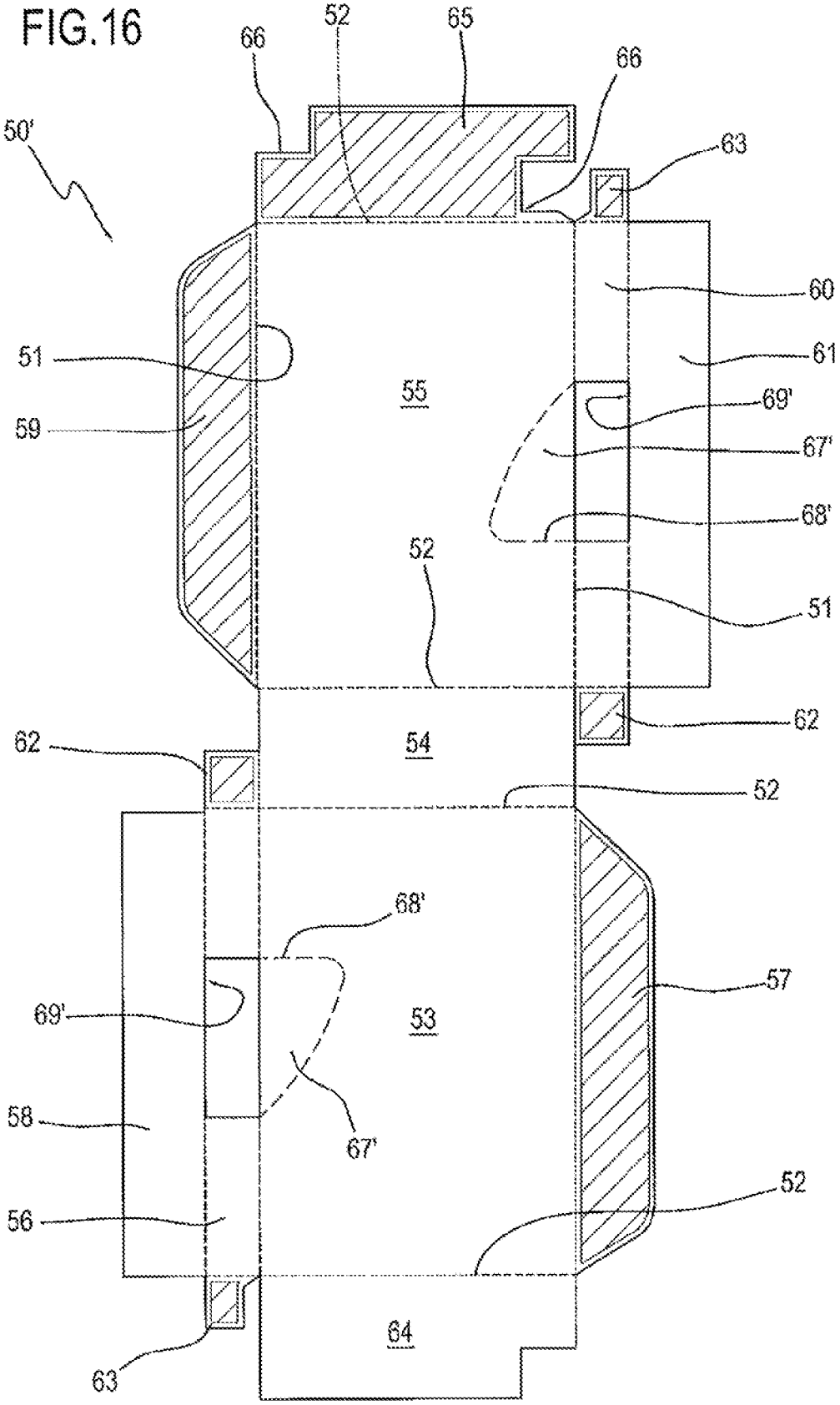
FIG. 16 is a plan view of a blank used to make a box-shaped body of the packet of FIGS. 14 and 15.

In order to allow the manual action which causes the mobile containers 40 to be partly pulled out of the box-shaped body 41, the longitudinally median zones of the larger side walls 45 of the box-shaped body 41 are provided, in the proximity of the smaller lateral faces 46' adjacent to them, with respective removable portions 67 defined by respective tearable lines of weakness 68 (in the blank 50' shown in FIG. 16 the removable portions 67 are labelled 67' and the lines of weakness 68'. and, where possible, the reference labels of the parts of the blank 50' are the same as those of the corresponding parts of the blank 50 of FIG. 10) In order to make it easier to grip these removable portions 67 manually, the smaller lateral faces 46' adjacent to them are provided with respective rectangular openings 69 (labelled 69' in the blank 50' shown in FIG. 16), bordering on the removable portions 67 themselves. It should be noted that the removable portions 67 might be made on any of the side walls of the containers 40, or on more than one side wall of the containers 40.

In use, the mobile containers 40 may be made to slide towards the outside of the box-shaped body 41 by urging them with a finger through the openings 70 created in the panels 45 and in the lateral faces 46' when the removable portions 67 are removed or folded.

Figure 17:
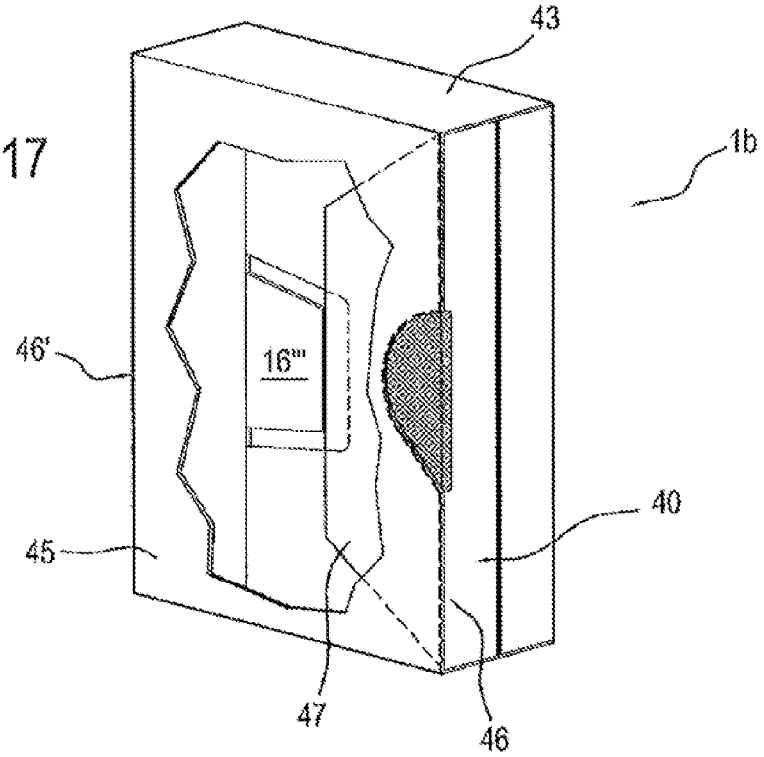
FIGS. 17 and 18 are perspective views of a further variant embodiment of the packet for tobacco products of FIGS. 1 and 2, in two respective different working situations.
Figure 18:
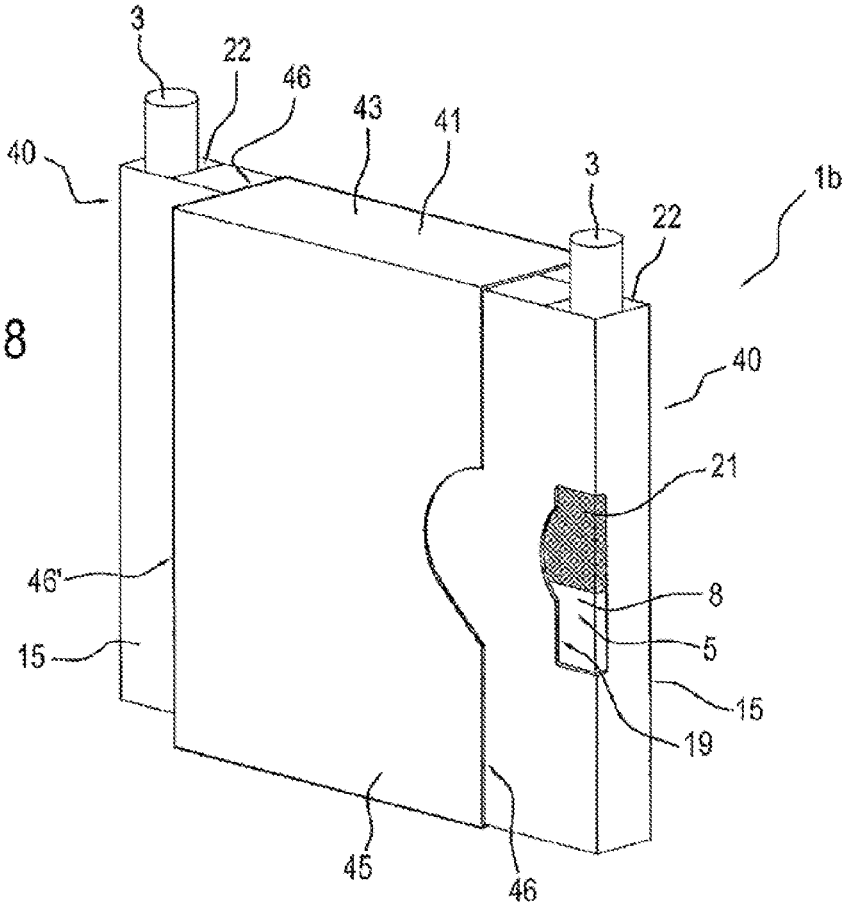

FIGS. 17 and 18 show a packet 1*b* constituting a further variant embodiment of the packet 1 of FIGS. 1 and 2.

Figure 19:
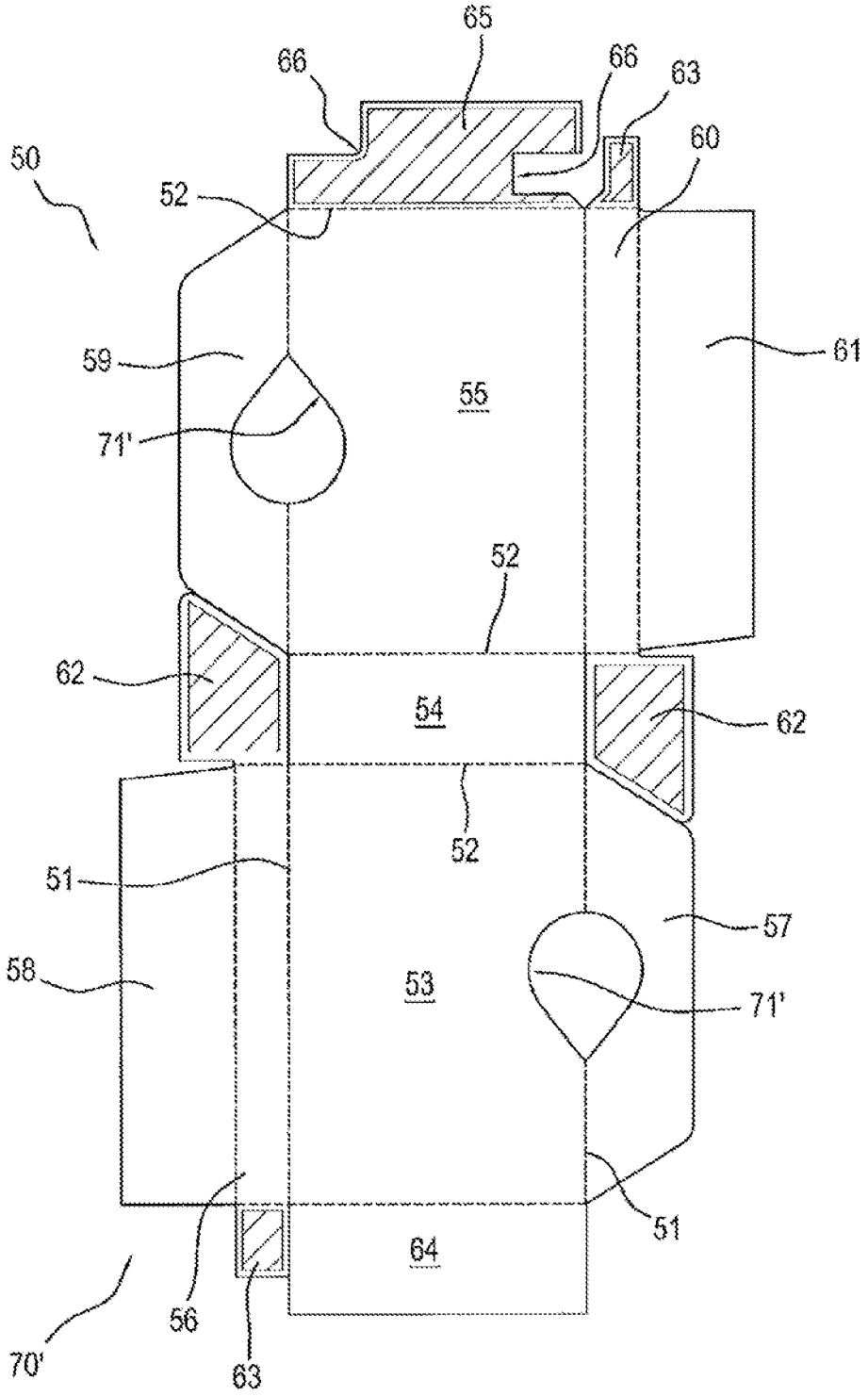
FIG. 19 is a plan view of a blank used to make a box-shaped body of the packet of FIGS. 17 and 18.

In order to allow the manual action which causes the mobile containers 40 to be partly pulled out of the box-shaped body 41, the longitudinally median zones of the larger side walls 45 and of the flaps 47 of the box-shaped body 41 are provided. In the proximity of the openings 46 respectively adjacent to them, with respective recesses 71 (having the shape of slots and labelled 71' in the blank 70' shown in FIG. 19). Preferably, each recess 71 makes the slot 19 of the outer container 6 adjacent to it accessible in such a way that the smoker can place a finger on the outer container 6 through the recess 71 and the adjacent slot 19 in order to partly extract the respective mobile container 40 from the box-shaped body 41. As a result, after the movement by which the mobile container 40 is extracted laterally from the box-shaped body, the smoker's finger is already at the slot 19, and is ready to urge the inner container 5 towards the raised position so that a cigarette 3 can be taken out.

Figure 20:
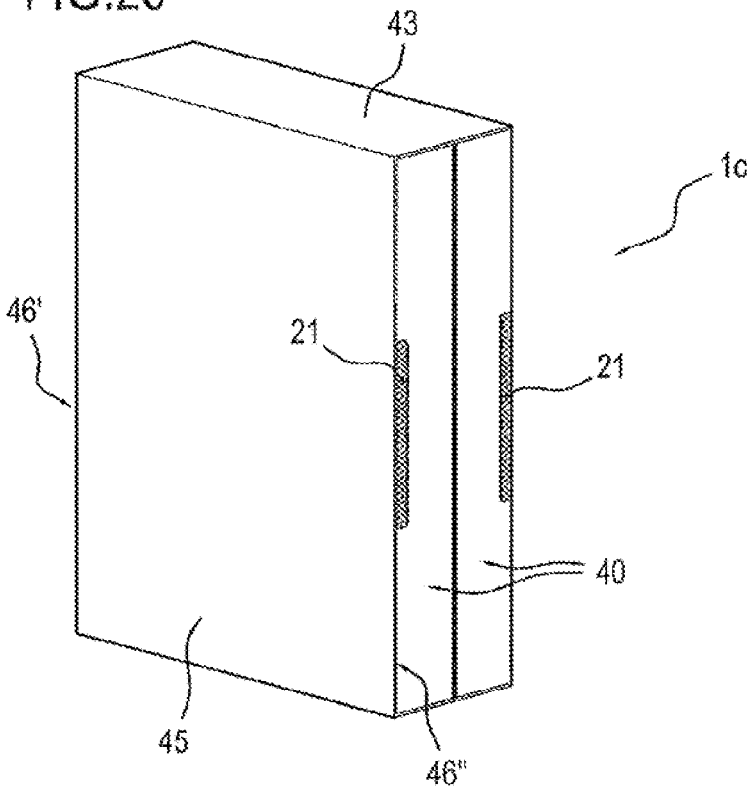
FIGS. 20 and 21 are perspective views of a further variant embodiment of the packet for tobacco products of FIGS. 1 and 2, in two respective different working situations.
Figure 21:
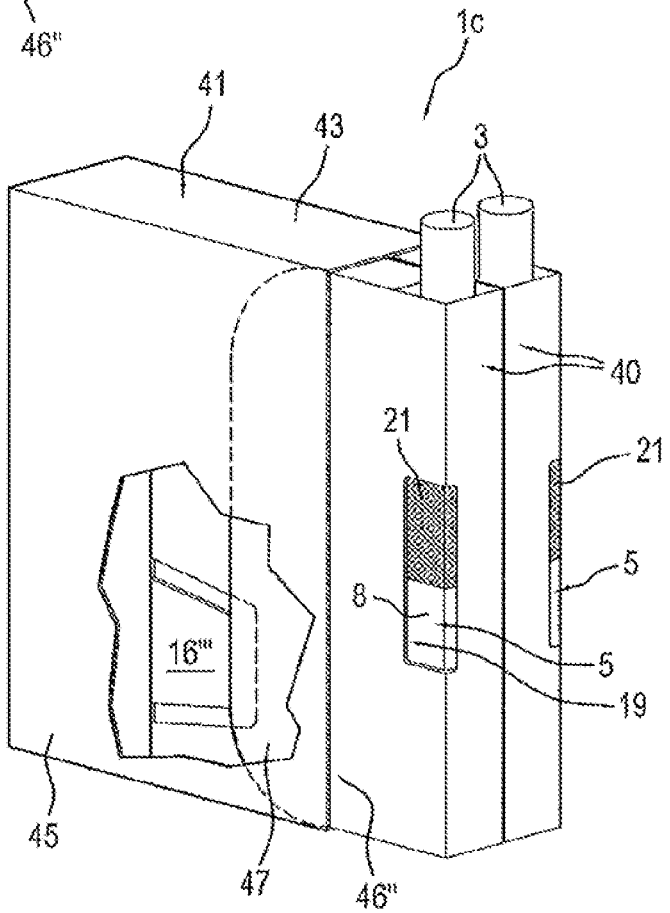

FIGS. 20 and 21 show a packet 1*c* constituting a further variant embodiment of the packet 1 of FIGS. 1 and 2.

The packet 1*c* differs from the above described packets 1, 1*a* and 1*b* in that the two mobile containers 40 can come out of the box-shaped body 41 through a single lateral opening 46", that is to say, each can slide both ways out of or into the box-shaped body 41 in the same direction as the other.

Figure 22:
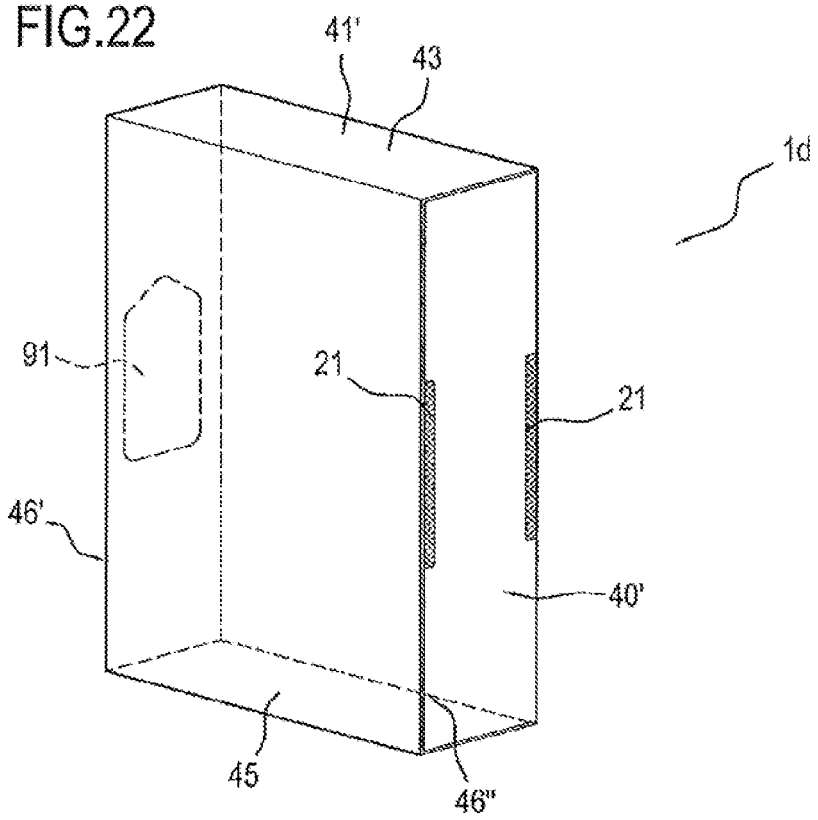
FIGS. 22 and 23 are perspective views of another variant embodiment of the packet for tobacco products of FIGS. 1 and 2, in two respective different working situations.
Figure 23:
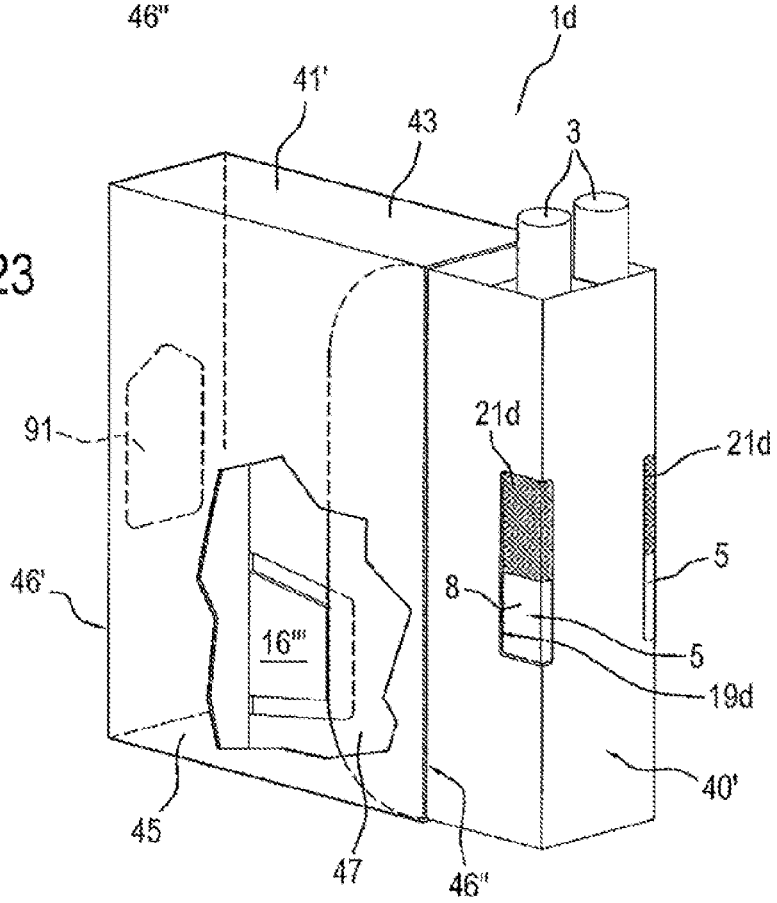

FIGS. 22 and 23 show a packet 1*d* constituting a further variant embodiment of the packet 1 of FIGS. 1 and 2.

The packet 1*d* comprises a box-shaped body 41' made in such a way as to contain a single mobile container 40' twice as large as those described up to now and capable, in use, of sliding horizontally in both directions into and out of the box-shaped body 41' through an opening 46" in a smaller lateral face of the box-shaped body 41' itself.

Figure 6:
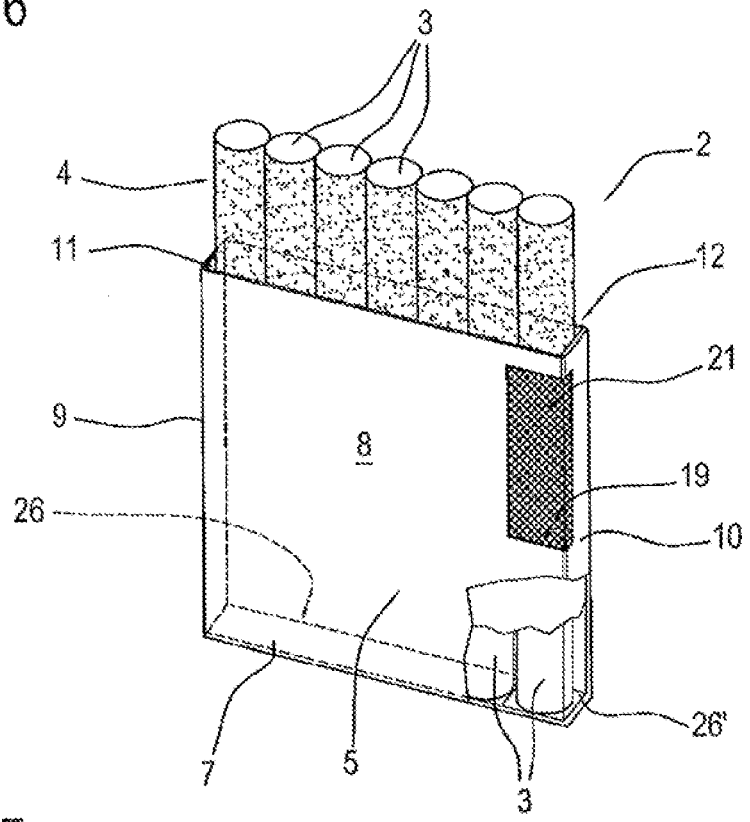
FIGS. 6 and 7 are perspective views of two containers, respectively inner and outer, forming part of the mobile container of FIGS. 4 and 5.

The mobile container 40' houses two inner containers 5 of the type described with reference to FIG. 6, placed side by side along respective larger side walls.

A zone substantially half way along each of the edges where the larger side walls 15*d* and the smaller side well 18*d* of the mobile container 40' meet has an opening in it which comprises a slot 19*d* through which a smoker can touch a lateral zone 21*d* of the respective inner container 5 in order to urge it vertically in both directions between the retracted and raised positions. It should be noted that in variant embodiments, not illustrated, of the packet 1*d* the slot 19*d* might be made in only one of the larger side walls 15*d* (preferably the front one), or one of the smaller side walls 18*d*.

In order to facilitate the manual pushing action which can be applied by the smoker on the front zone 21*d* of the inner container 5, the surface of the zone 21*d* may be provided with knurling or other roughening feature.

In a variant embodiment, not illustrated, of the packet 1*d*, the sliding of the inner containers 5 in both directions within the mobile container 40' might be caused, in a manner similar to that of the inner container 5 of FIG. 12, by manually pulling each inner container 5 up or down using a respective gripping element comprising a tab (not illustrated) which is the same as the aforementioned tab 35 associated with the inner container 5 and coming out of the mobile container 40' through a slit similar to the aforementioned vertical slits 36.

Figure 24:
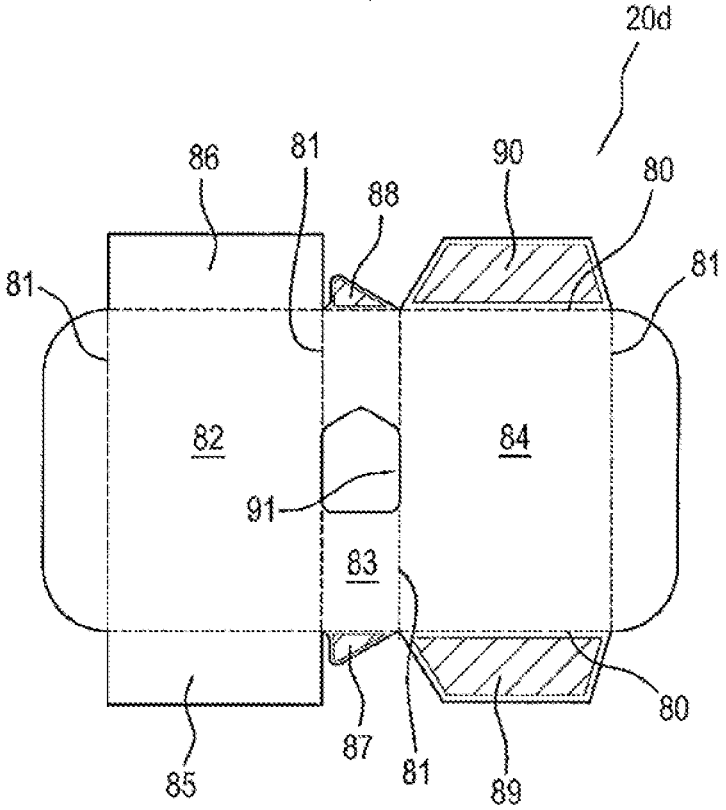
FIG. 24 is a plan view of a blank used to make box-shaped body of the packet of FIGS. 22 and 23.

With reference to FIG. 24, the blank 20*d* from which the box-shaped body 41' of the packet 1*d* is obtained has two transversal lines of weakness 80 and a plurality of longitudinal lines of weakness 81 which define, between the two transversal lines of weakness 80, a panel 82 constituting one larger side wall 15*d* of the packet 1*d*, a panel 83 constituting the smaller side wall 18*d* and a panel 84 constituting the other larger side wall 15*d*. The panel 82 has a pair of flaps 85 and 86, which are located on opposite sides of the panel 82, are separated from the panel 82 by the transversal lines of weakness 80, and constitute an external portion of the bottom and top walls of the packet 1*d*; the panel 83 has a pair of flaps 87 and 88, which are located on opposite sides of the panel 83, are separated from the panel 83 by the transversal lines of weakness 80, and constitute an internal portion of the bottom and top walls of the packet 1*d*; and the panel 84 has a pair of flaps 89 and 90, which are located on opposite sides of the panel 84, are separated from the panel 84 by the transversal lines of weakness 80, and constitute an internal portion of the bottom and top walls of the packet 1*d*. The flaps 87 and 88 and the flaps 89 and 90 are shaped in such a way that they do not overlap when they are folded against the flaps 85 and 86 to form the top and bottom walls of the packet 1*d*.

Lastly, the panel 83 is provided, in a substantially median zone of it, with a hole 91 whose shape and size are such as to allow a user's finger to pass through it. The purpose of the hole 91 is to facilitate extracting the mobile container 40' from the box-shaped body 41' by allowing a user to apply a pushing action on the smaller side wall 18*d* of the mobile container 40' facing the hole 91 when the packet 1*d* is in the closed position illustrated in FIG. 22.

Figure 25:
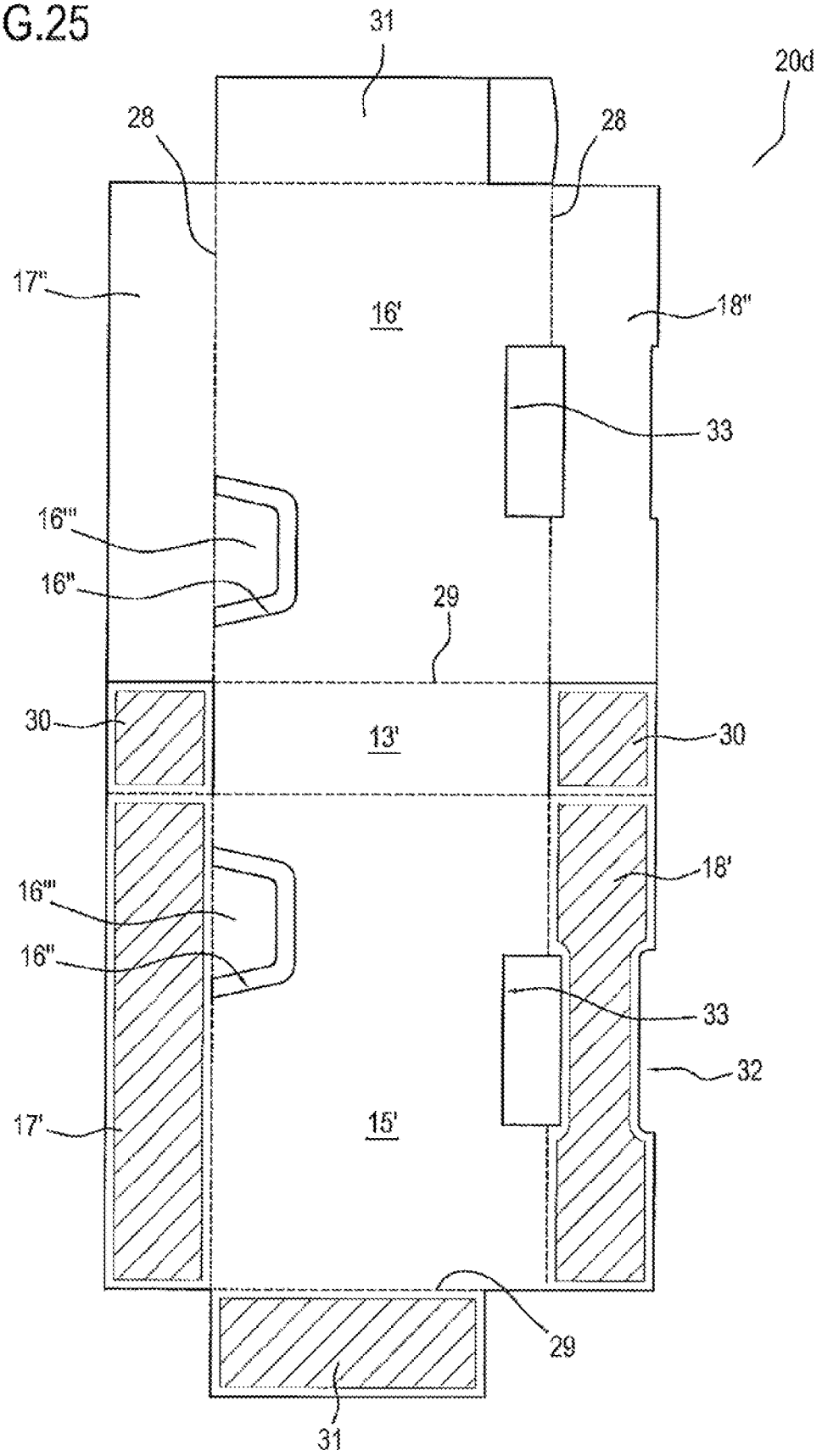
FIG. 25 is a plan view of a further blank used to make the packet of FIGS. 22 and 23.

The blank 20*d*, shown in FIG. 25, used to make the mobile container 40' of the packet 1*d* is similar to the blank 20 of FIG. 9, where the reference numerals are the same as those of the blank 20*d*.

Unlike the blank 20, the blank 20*d* has two elongate slots 33, located at the longitudinally median parts of the zones of connection between the panel 16' and the side flap 18" and between the panel 15' and the side flap 18'. The blank 20*d* also has two incisions 16", defining respective substantially trapezoidal tabs 16'" whose larger bases coincide, respectively, with a portion of the longitudinal line 28 which separates the panel 16' from the flap 17 and with a portion of the longitudinal line 28 which separates the panel 16' from the flap 17'. Lastly, the blank 20*d* does not have the wing 6'.

It will be understood that all the variant embodiments of the parts of the packets 1, 1*a*, 1*b*, 1*c* and 1*d* described above, such as, for example, the gripping element 35 or the slot 19 are applicable to all of the packets 1, 1*a*, 1*b*, 1*c* and 1*d* even where not expressly specified.

It should be noted that in each of the above described mobile containers 40, 40' the supporting portion 26' and the extraction zone 12 might be of a size substantially equal to a multiple of the diameter of a cigarette 3. In this case, the upward movement of the inner container 5 would cause the upper portions of two or more cigarettes 3 to come out through the zone 12. After taking out one of these cigarettes 3, the smoker would re-lower the inner container 5, thereby causing the remaining, partly protruding cigarettes 3 to return into the outer container 6.

The cigarettes 3 inside the inner containers 5 might also be arranged in two or more rows side by side, instead of in a single row 4. In this case, too, the supporting portion 26' might have two or more cigarettes 3 on it, side by side, the upward movement of the inner containers 5 would cause the upper portions of two or more cigarettes 3 to come out through the zone 12 and after taking out one of these cigarettes 3, the smoker would re-lower the inner containers 5, thereby causing the remaining, partly protruding cigarettes 3 to return into the outer container 6.

The invention claimed is:

1. A packet for tobacco products with facilitated extraction of the tobacco products, comprising:

at least one mobile container for receiving the tobacco products, and a box-shaped body, housing the at least one mobile container such that the mobile container can slide relative to the box-shaped body between a closed position, in which the at least one mobile container is completely inserted in the box-shaped body, and an open position, in which a part of the at least one mobile container is extended from the box-shaped body;

a stop for limiting sliding of the at least one mobile container relative to the box-shaped body to prevent separation of the at least one mobile container from the box-shaped body, the at least one mobile container comprising:

an inner container substantially shaped as a parallelepiped, housing a group of elongate tobacco products which are positioned side by side in at least one row, each tobacco product comprising a pickup end portion which can be manually gripped and a second end portion opposite the pickup end portion, the inner container also comprising a bottom wall positioned at the second end portions of the tobacco products; and an outer container shaped as a parallelepiped, housing the inner container slidably in parallel with axes of the tobacco products, thus allowing the inner container to slide between a retracted position, in which the inner container bottom wall is adjacent to a bottom wall of the outer container and all of the tobacco products are completely contained in the inner container, and an extended position, in which the inner container is positioned close to a top wall of the outer container;

the bottom wall of the inner container forming a supporting portion for abutting the second end portion of at least one of the tobacco products present in the inner container;

the top wall of the outer container comprising an opening; and each sliding action of the inner container towards the extended position causing an axial movement towards the top wall of the outer container of the at least one tobacco product abutting the supporting portion and causing the pickup end portion of the at least one tobacco product abutting the supporting portion to extend out through the opening in the outer container.

2. The packet according to claim 1, wherein the stop comprises at least a first tab, projecting from a respective larger side wall of the at least one mobile container towards an exterior of the at least one mobile container, and a second tab, projecting from a respective larger side wall of the box-shaped body towards an interior of the box-shaped body and positioned close to a corresponding opening in the box-shaped body; the first and second tabs being positioned such that the first tab couples with the second tab during extraction sliding of the at least one mobile container from the box-shaped body.

3. The packet according to claim 2, wherein the first tab is located in a position such that one of its edges makes contact with a corresponding edge of the second tab of the box-shaped body during extraction sliding of the at least one mobile container from the box-shaped body.

4. The packet according to claim 1, and further comprising a pickup device associated with the at least one mobile container to allow a manual action which causes the at least one mobile container to partly come out of the box-shaped body.

5. The packet according to claim 4, wherein the pickup device comprises a wing integral with the at least one mobile container and projecting towards the exterior of the body of the packet.

6. The packet according to claim 1, wherein at least one side wall of the box-shaped body includes a portion which can be at least partly removed, defined by lines of weakness which can be torn, to allow a manual pulling action to cause the at least one mobile container to partly come out of the box-shaped body.

7. The packet according to claim 1, wherein a side wall of the box-shaped body includes a hole with shape and size such that it allows the passage of a finger of a user for applying a thrust on the at least one mobile container, for causing the at least one mobile container to partly come out of the box-shaped body.

8. The packet according to claim 1, wherein at least one side wall of the box-shaped body includes, close to an opening through which the at least one mobile container comes out of the box-shaped body, at least one recess to allow a user manual access to the at least one mobile container for partly extracting the at least one mobile container from the box-shaped body.

9. The packet according to claim 1, wherein the supporting portion of the inner container of the at least one mobile container has a width smaller than a width of the inner container, and a remaining portion of the bottom of the inner container, which can be occupied by the second end portions of the tobacco products of the group and positioned close to the supporting portion, is open and allows the tobacco products which do not abut the supporting portion to be positioned adjacent a bottom wall of the related outer container.

10. The packet according to claim 1, wherein the outer container of the at least one mobile container includes a further opening through which a user can manually act on the inner container to cause sliding actions of the inner container between the retracted position and the extended position.

11. The packet according to claim 10, wherein the inner container of the at least one mobile container comprises a grip element integral with the inner container and extending out of the outer container through the further opening.

12. The packet according to claim 11, wherein the grip element comprises a tab integral with the inner container; the further opening comprising a vertical slit made in the outer container.

13. The packet according to claim 1, wherein the inner container of the at least one mobile container houses an elastic element for pushing the tobacco products transversally towards the supporting portion.

14. The packet according to claim 1, wherein the box-shaped body houses two mobile containers, with larger side walls of the two mobile containers being positioned side by side; the two mobile containers able to slidingly extend out of the box-shaped body in respective opposite directions and parallel with each other, through respective side portions of the box-shaped body which are opposite one another.

15. The packet according to claim 1, wherein the box-shaped body houses two mobile containers, with larger side walls of the two mobile containers being positioned side by side; the two mobile containers able to slidingly extend out of the box-shaped body in a same direction, through a side portion of the box-shaped body.

16. The packet according to claim 1, wherein the box-shaped body houses the at least one mobile container which is able to partly extend out of the box-shaped body through a side portion of the box-shaped body.

17. The packet according to claim 1, wherein the supporting portion abuts only a single one of the tobacco products present in the inner container and each sliding action of the inner container towards the extended position causes an axial movement towards the top wall of the outer container of the single one of the tobacco products abutting the supporting portion and causes the pickup end portion of the single one of the tobacco products abutting the supporting portion to extend out through the opening in the outer container.

* * * * *